US006592115B2

(12) United States Patent
Yamaguchi

(10) Patent No.: US 6,592,115 B2
(45) Date of Patent: Jul. 15, 2003

(54) STAPLER WITH SINGLE DRIVING SOURCE

(75) Inventor: Morio Yamaguchi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 115 days.

(21) Appl. No.: 09/793,592

(22) Filed: Feb. 27, 2001

(65) Prior Publication Data

US 2001/0026361 A1 Oct. 4, 2001

(30) Foreign Application Priority Data

Feb. 28, 2000 (JP) ..... 2000-052595

(51) Int. Cl.[7] ..... B25C 5/15

(52) U.S. Cl. ..... 270/58.08; 227/111; 227/131; 227/154; 227/155

(58) Field of Search ..... 270/58.07, 58.08; 227/131, 111, 154, 155

(56) References Cited

U.S. PATENT DOCUMENTS 5,413,266 A 5/1995 Jairam ..... 227/129
5,460,314 A * 10/1995 Udagawa ..... 227/131
5,806,750 A * 9/1998 Yamanushi et al. ..... 227/131
5,975,396 A * 11/1999 Manabe ..... 227/131
6,223,965 B1 * 5/2001 Nakatsuka ..... 227/111

FOREIGN PATENT DOCUMENTS

| | | | |
|---|---|---|---|
| EP | 0 612 594 | 8/1994 | ..... B27F/7/38 |
| JP | 6-63342 | 9/1994 | |
| JP | 7-24211 | 6/1995 | |

* cited by examiner

*Primary Examiner*—Patrick H. Mackey
(74) *Attorney, Agent, or Firm*—Morgan, Lewis & Bockius LLP

(57) ABSTRACT

A sheet postprocessing apparatus includes a magazine unit and a clincher unit. The magazine unit has a driver which is vertically movable relative to a magazine for storing staple sheets. The clincher unit has a clincher holder, a driving mechanism for vertically moving the clincher holder, and a driving source of the driving mechanism. The magazine unit and the clincher unit are disposed vertically opposite to each other. In the sheet postprocessing apparatus, a material to be stapled is inserted between the magazine unit and the clincher unit. The clincher holder of the clincher unit is moved closer to the magazine unit by using the driving source so that a staple may be passed through the material and bent.

11 Claims, 7 Drawing Sheets

STAPLER WITH SINGLE DRIVING SOURCE

BACKGROUND OF THE INVENTION

1. Field of the Invention

The present invention relates to a vertically separate type sheet postprocessing apparatus wherein a driver unit and a clincher unit are separated from each other.

2. Description of the Related Art

Sheet postprocessing apparatus are generally adapted to bend a foremost one of staples formed in sheet into a gate shape and to drive out the foremost staple. The staples formed in sheet (hereinafter referred as "staple sheet") are composed of connected straight staples to be a form of a sheet. Among such sheet postprocessing apparatus, there are the following conventional types. One type includes a forming/driving portion for forming and driving out the staple, and a clincher portion for bending the driven staple. In this type, the forming/driving portion and the clincher portion are pivotally coupled together at one end. In another type, a forming/driving portion and a clincher portion are vertically separated from each other in order to provide an opening therebetween. In the case of such a vertically separate type sheet postprocessing apparatus, it is possible to feed a material to be stapled from one side and to retrieve it from the opposite side because the material to be stapled can be passed through the space between the forming/driving portion and the clincher portion, which has the stapling work speedily done. Moreover, the advantage in this case is that a material can be stapled at its intermediate portion.

Notwithstanding, because a driving source is needed to drive a forming plate and a driver in a forming/driving portion and another driving source is also needed to drive a movable clincher in a clincher portion, driving motors have been mounted in the forming/driving portion and the clincher portion respectively in the conventional separate type sheet postprocessing apparatus as disclosed in JP-A-6-63342U.

However, mounting the driving motors respectively in the forming/driving and clincher portions results in making wiring for exchanging signals by connecting upper and lower cables complicated and also making the structure complicated as the forming/driving portion has to be moved. Consequently, the problem is that not only an increase in costs but also trouble will be brought about.

SUMMARY OF THE INVENTION

An object of the present invention intended to solve the foregoing problems is to provide a vertically separate type sheet postprocessing apparatus capable of performing a stapling operation with one driving source.

In order to solve the problems above, a vertically separate type sheet postprocessing apparatus according to the invention comprises a magazine unit having a driver which is vertically movable relative to a magazine for storing staple sheets, each of the staple sheets being formed by connecting straight staples together in the form of a sheet, and a clincher unit having a clincher holder, a driving mechanism for vertically moving the clincher holder, and a driving source of the driving mechanism, the magazine unit and the clincher unit being disposed vertically opposite to each other, and is characterized by receiving a material to be stapled between the magazine unit and the clincher unit and moving the clincher holder of the clincher unit closer to the magazine unit by using the driving source so that a staple may be passed through the material and bent.

DETAILED DESCRIPTION OF THE PREFERRED EMBODIMENTS

Figure 1:
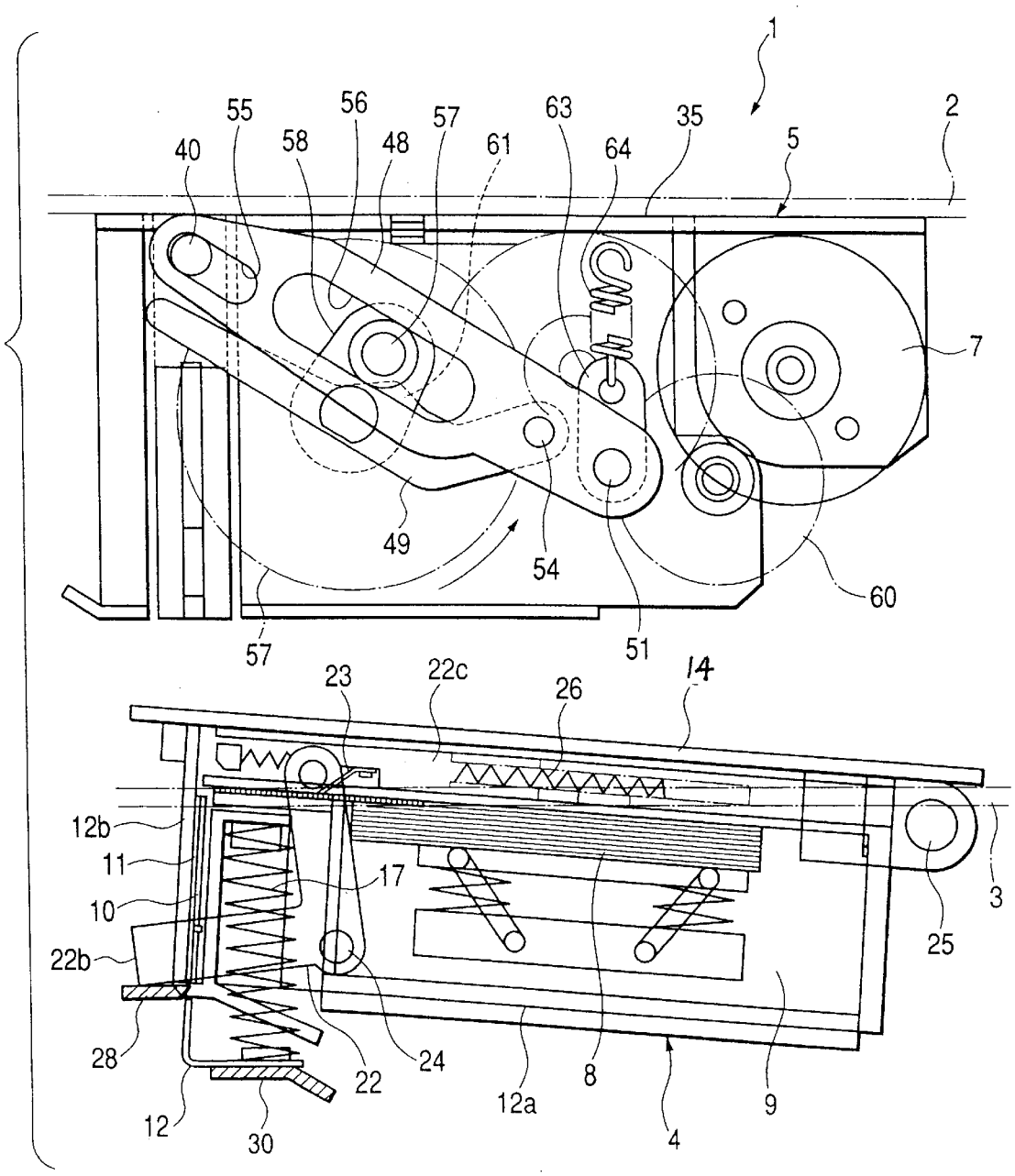
FIG. 1 is a side view of a vertically separate type sheet postprocessing apparatus according to the present invention.

In FIG. 1, reference numeral 1 denotes a sheet postprocessing apparatus. The sheet postprocessing apparatus 1 has a magazine unit 4 and a clincher unit 5 that are disposed vertically opposite to each other on parallel base frames 2 and 3 and is adapted to receive a material 6 to be stapled between the magazine unit 4 and the clincher unit 5 and to move the clincher unit 5 closer to the magazine unit 4 by means of a driving source 7 so that a staple can be passed through the material 6 and bent.

Figure 2:
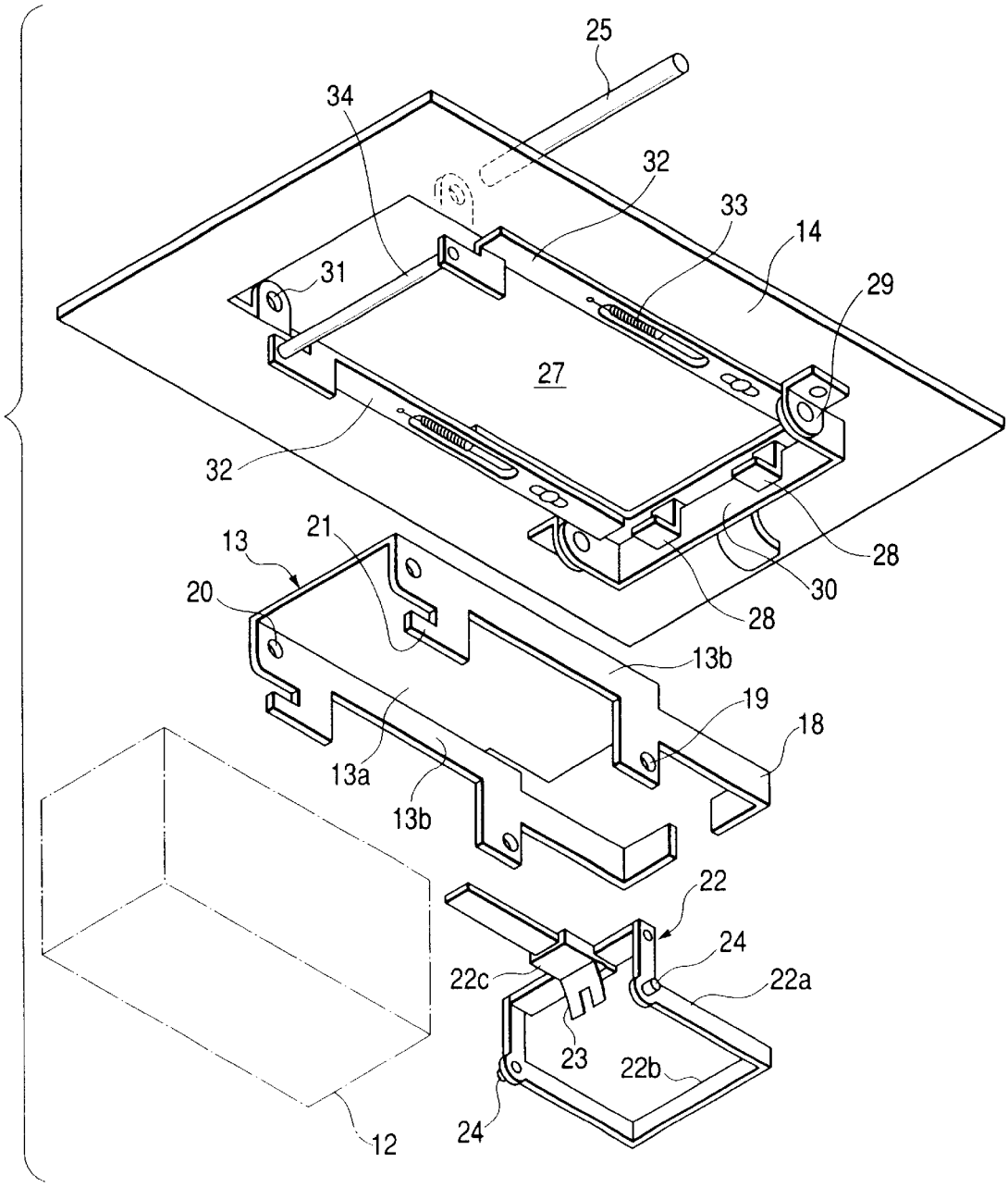
FIG. 2 is an exploded perspective view of the principal part of a magazine unit.
Figure 3:
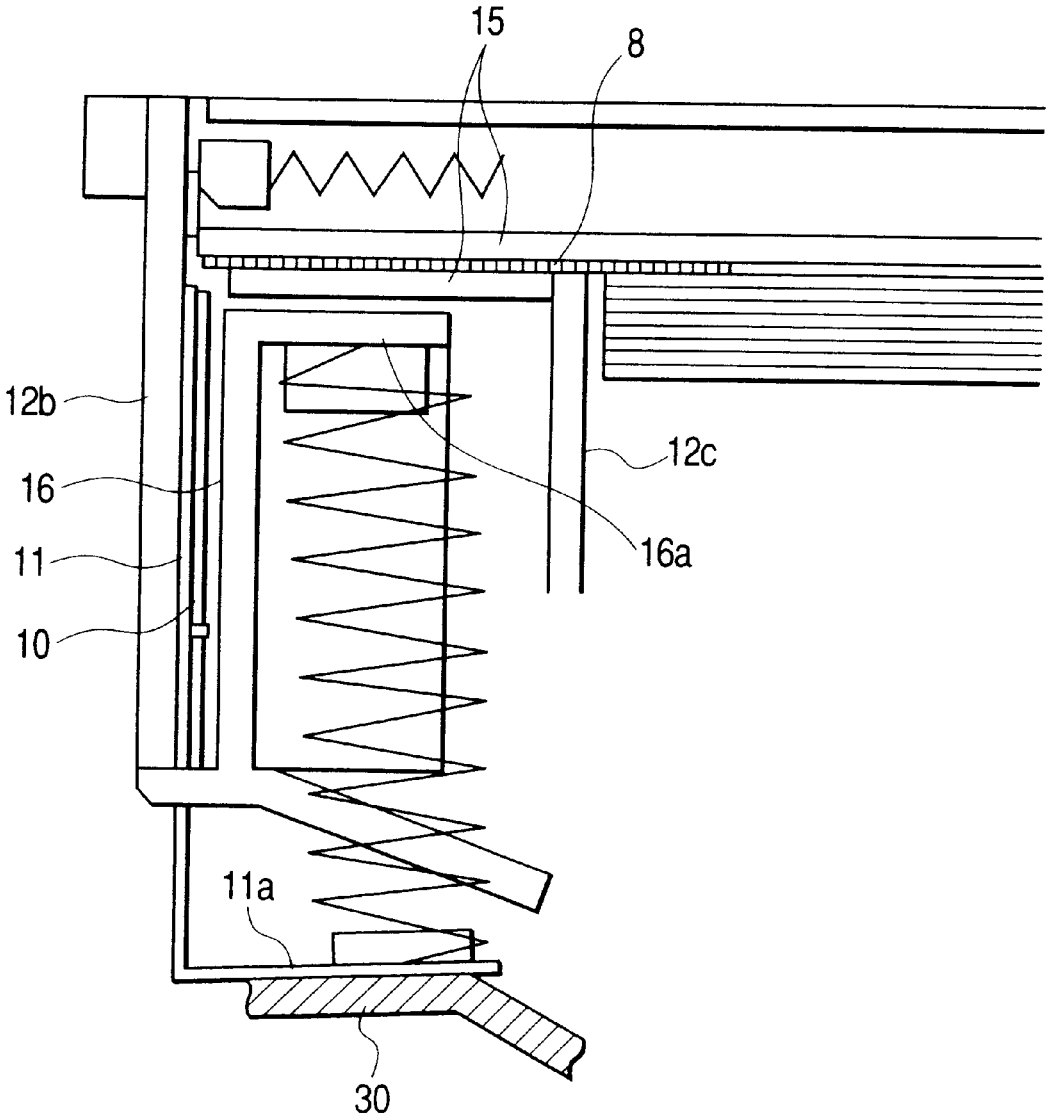
FIG. 3 is an enlarged view of the front end portion of a magazine.

As shown in FIGS. 1, 2 and 3, the magazine unit 4 comprises a magazine 12 in which a forming plate 10 and a driver plate 11 are vertically movably provided relative to a magazine body 12*a* including a storage 9 of staple sheets 8, each being made up of straight staples connected together in the form of a sheet; a magazine holder 13 detachably holding the magazine 12; and a base plate 14 for securing the magazine holder 13 to the base frame 2. FIG. 1 mainly shows the magazine 12.

Figure 6:
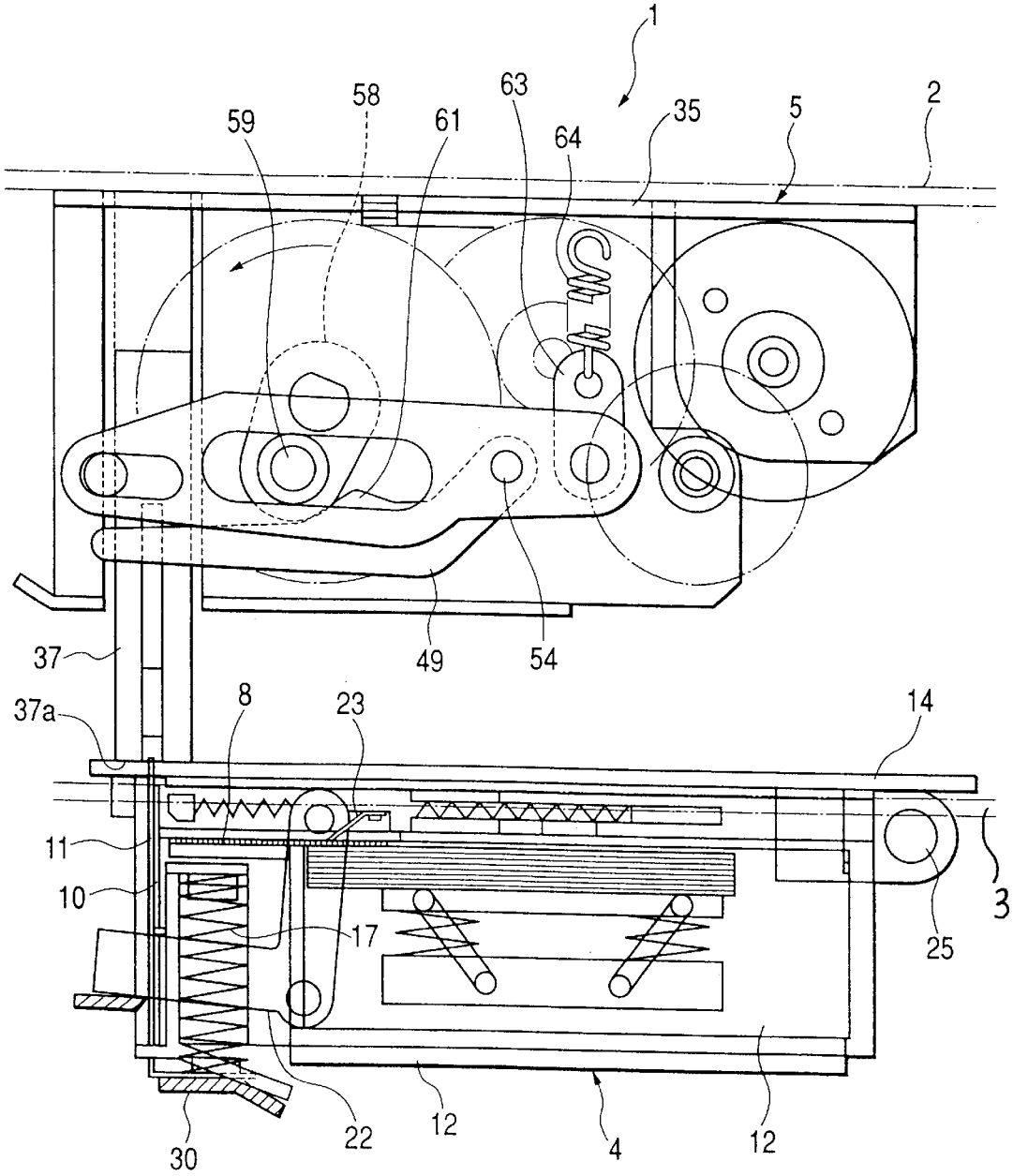
FIG. 6 is a diagram explanatory of the operating mode of the sheet postprocessing apparatus.

The magazine 12 is provided with the storage 9 for storing the staple sheets 8 with piling up in plural layers and a sheet guide 15 for forwardly guiding the staple sheet 8 guided out of the storage 9 with the forming plate 10 and the driver plate 11 disposed in the still forward position of the sheet guide 15. The forming plate 10 is held integrally by the driver plate 11 and the lower end of the driver plate 11 is bent at a right angle. A driver returning spring 17 is disposed between a bent portion 11*a* of the driver plate 11 and a bent portion 16*a* of a cassette subframe 16 provided in the front lower portion of the magazine 12, so that the forming plate 10 and the driver plate 11 are always vertically movably installed with respect to the magazine body 12*a*. Reference characters 12*b* denotes a face plate, and 12*c* denotes a separator for separating the staple sheets from other members. Incidentally, the forming plate 10 and the driver plate 11 are like what is shown in FIG. 6 and so on of JP-B-7-24211U, used to form each of the straight staples into the shape of a gate and to drive out the staples thus formed.

The magazine holder 13 is formed with a side plate 13*b* uprightly formed on both sides of a base 13*a*, a positioning segment 18 formed in the front end portion of each side plate 13*b*, bearing holes 19 and 20 formed in the front and rear end portions of the respective side plates 13*b*, and mating grooves 21 that are opened rearward and formed in the rear end portion of the magazine holder 13. The shaft portion 24 of a staple sheet feed link 22 is pivotally fitted in the front bearing holes 19. The staple sheet feed link 22 includes a pair of lateral L-shaped feed links 22*a* whose front ends are coupled together by a coupling segment 22*b*, a feed pawl holder 22*c* pivotally coupled to the rear end thereof, and a feed pawl 23 secured to the feed pawl holder 22*c*. As shown in FIG. 1, the staple sheet feed link 22 is always urged forward by a spring 26.

An opening 27 capable of housing the magazine holder 13 is formed in the base plate 14. A pair of L-shaped mating segments 28 are formed in the front portion of the opening 27, and a holding frame 30 is pivotally mounted to the fitting portion 29 uprightly formed on both sides of opening 27. A bearing portion 31 is formed in the lower rear portion of the opening 27. Further, a slide segment 32 is longitudinally slidably disposed relative to the base plate 14 on both sides of the opening 27 via each of the springs 33. A mating shaft 34 is mounted to the upright rear end portions of the respective slide segments 32.

With the arrangement above, while the magazine holder 13 is housed in the opening 27 of the base plate 14, the support shaft 25 of the base plate 14 is supported in the bearing holes 20 of the rear end portion of the magazine holder 13, and the mating shaft 34 of the rear end portions of the slide segments 32 is mated with the respective mating grooves 21 of the magazine holder 13. At this time, the coupling segment 22*b* at the front of the staple sheet feed links 22 mates with the mating segments 28 of the base plate 14. The magazine 12 is then mated with the positioning segments 18 of the magazine holder 13 and mounted thereto and by pivoting the holding frame 30 of the base plate 14, mated with the bent portion 11*a* of the driver plate 11 at the front end of the driver plate 12. Thus, the fronts of the magazine 12 and the magazine holder 13 are slightly tilted upward relative to the base plate 14 and become pivotal downward on the support shaft 25. In this case, the driver plate 11 and the forming plate 10 are as shown in FIG. 6 held down by the holding frame 30 of the base plate 14 and fixed, so that only the magazine 12 and the magazine holder 13 pivot. After pivoting up to the pivoting end, the magazine 12 and the magazine holder 13 are caused to pivot on the support shaft 25 by the driver returning spring 17 and return to the original position.

The pivoting of the magazine 12 and the magazine holder 13 downward while the driver plate 11 and the forming plate 10 remain fixed means otherwise that the driver plate 11 and the forming plate 10 are driven upward relative to the fixed magazine 12 and magazine holder 13. Consequently, the legs of the forefront staple of the staple sheet 8 in the magazine 12 become U-shaped before being conveyed to the upward of the driver plate 11. When the driver plate 11 and the forming plate 10 are driven again, the staple thus formed is driven upward by the driver plate 11 and this is followed by forming of the second staple. Thus, the forming and driving operation is performed each time both the plates make the relative movement with respect to the magazine 12.

When the magazine holder 13 pivots down, the staple sheet feed links 22 also move downward. However, as the coupling segment 22*b* of the feed links 22 are mated with the mating segments 28 and held in the fixed condition, the staple sheet feed links 22 pivot on the respective shaft portions 24 of the bent portions. Therefore, the feed pawl 23 moves toward the rear of the staple sheet 8 as shown in FIG. 6. When the magazine holder 13 pivots upward and then returns to the original position as shown in FIG. 1, the staple sheet feed links 22 pivot to the opposite side on the shaft portion 24 at this time. As the feed pawl 23 is mating with the staple sheet 8 at this time, the staple sheet 8 is also fed forward. Normally, one staple is fed.

Figure 4:
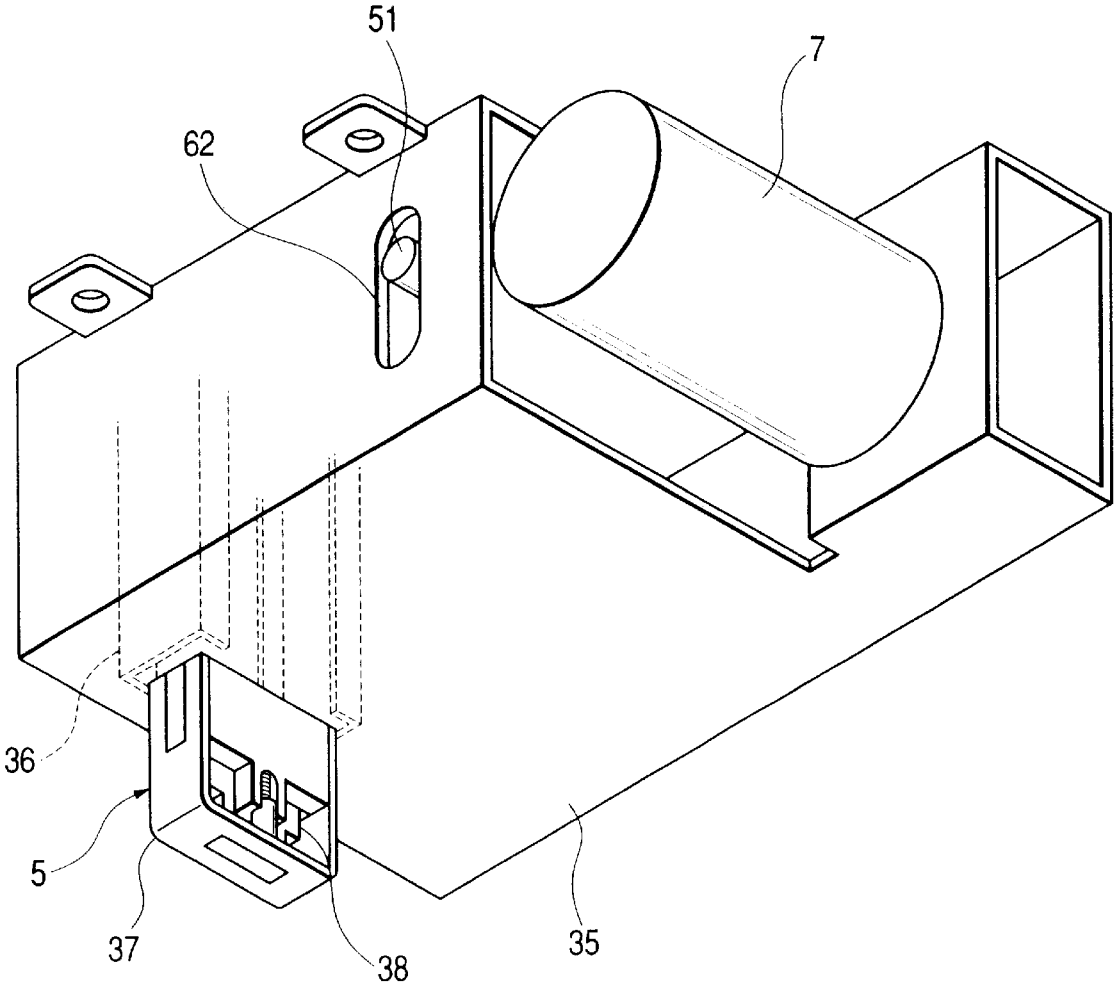
FIG. 4 is a perspective view of a clincher unit.

As shown in FIG. 4, the clincher unit 5 includes a clincher holder 37 vertically movably disposed along guide rails 36 on the respective sides of a casing 35, a clincher 38, and a driving mechanism for driving the clincher holder 37 vertically relative to the casing 35.

Figure 5:
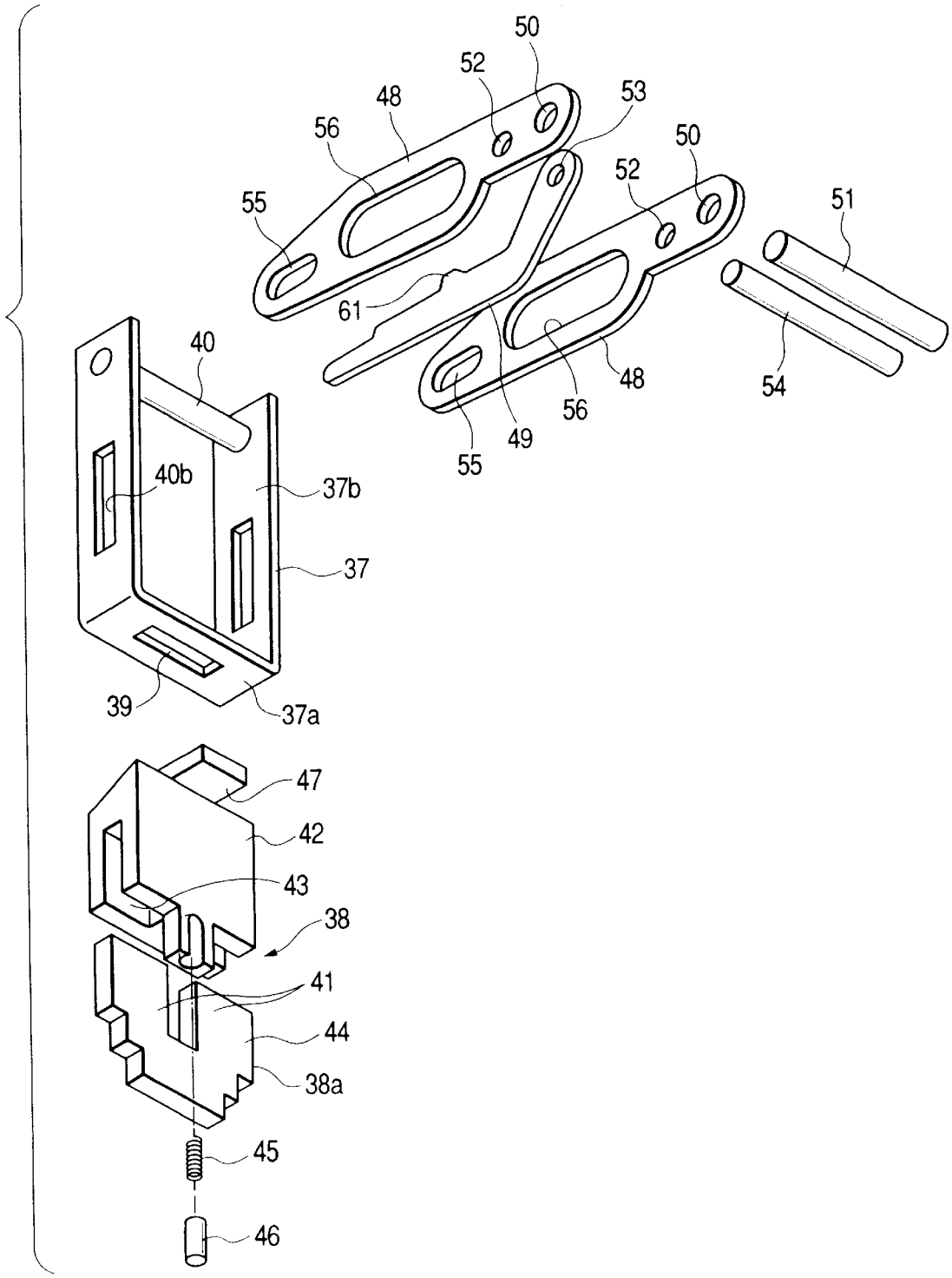
FIG. 5 is an exploded perspective view of the principal part of the clincher unit.

As shown in FIGS. 4 and 5, the clincher holder 37 is fabricated by shaping a gate form with a lower paper receiving segment 37*a* and both side segments 37*b*, opening a clincher slot 39 in the paper receiving segment 37*a*, forming guide holes 40*b* in the respective side segments 37*b* and coupling a shaft 40 to the end portions of both the side segments 37*b*.

In the clincher 38, the following arrangement is made: the forked portion 41 of a metal clincher body 38*a* is inserted into the receiving slot 43 of a clincher receiving member 42; the front end of the clincher body 38*a* is fitted in the clincher slot 39 of the paper receiving segment 37*a* of clincher holder 37 in a manner extractable therefrom and moreover both side projected segments 44 of the clincher body 38*a* are vertically movably fitted into the respective guide holes 40*b* of both the side segments 37*b* of the clincher holder 37; a mating hole is formed in the end portion of the clincher receiving member 42, and a compression spring 45 and a thrust-out pin 46 are inserted into the mating hole; one end of the thrust-out pin 46 mates with the back surface of the paper receiving segment 37*a* of the clincher holder 37; and a mating segment 47 projecting inward is formed in an end portion opposite to the opening of the receiving slot 43 of the clincher receiving member 42.

Figure 7A:
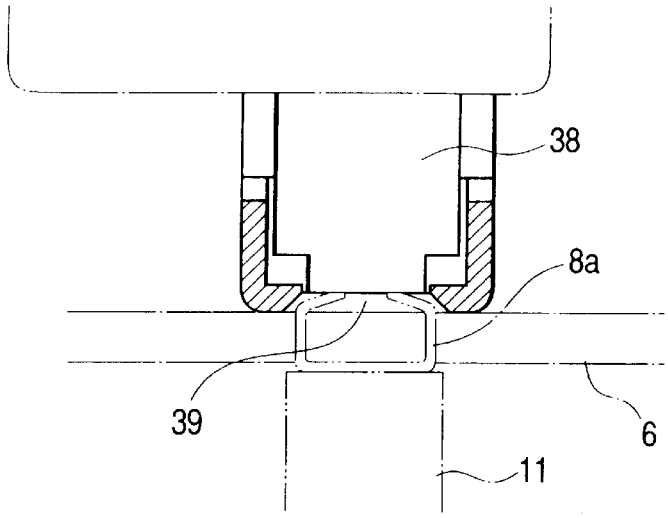
FIGS. 7(*a*) and 7(*b*) are diagrams explanatory of the operating mode a clincher.
Figure 7B:
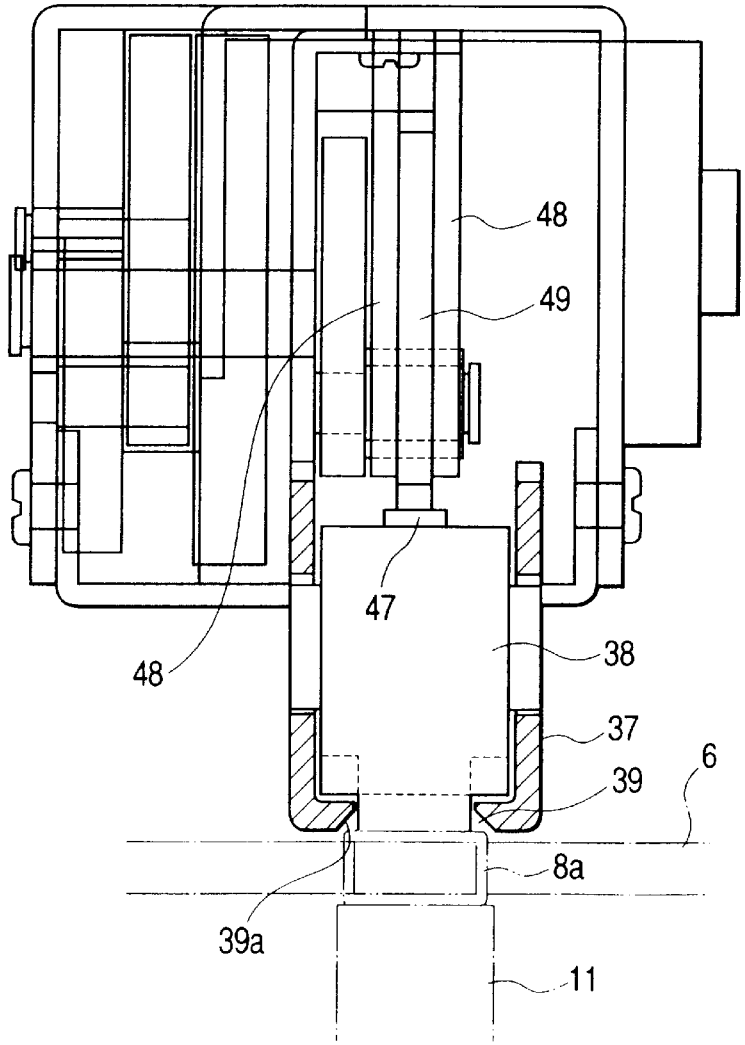

In the driving mechanism, the following arrangement is made: a clincher lever 49 for driving the clincher 38 is disposed between two sheets of cam levers 48 for driving the clincher holder 37 (see FIG. 7(*b*)); a shaft 51 fitted in a slot 62 (see FIG. 4) vertically formed in the casing is supported by each bearing hole 50 at one end of the cam levers 48; the cam levers 48 and the clincher lever 49 are coupled together by passing a coupling rod 54 through holes 52 near the bearing holes 50 and a hole 53 in the end portion of the clincher lever 49; the shaft 40 of the clincher holder 37 is mated with a mating slot 55 in the end portion of each cam lever 48; and the roller 59 of a crank arm 58 provided to a driving gear 57 mounted to the casing 35. The driving gear 57 is coupled to a motor (driving source) via an intermediate gear 60. The clincher lever 49 is formed in a manner resembling a symbol "Λ", that is, a chevron portion 61 is formed in the intermediate portion of its inside edge.

As shown in FIG. 1, the shaft 51 which is the rotary shaft of the cam lever 48 is vertically movable along the slot 62 and at the same time coupled to the upper portion of the casing 35 via a link 63 and a spring 64.

With the above arrangement, the torque of the motor 7 is transmitted to the driving gear 57 via the intermediate gear 60 so as to rotate the crank arm 58. As the cam levers 48 and the clincher lever 49 vertically pivot on the shaft 50 with the rotation of the crank arm 58, the clincher holder 37 also moves vertically. When the crank arm 58 rotates, the roller 59 moves along the inside edge of the slot 56 of the cam lever. However, when the roller 59 of the crank arm 58 mates with the chevron portion 61 of the clincher lever 49 as shown in FIG. 6, the clincher lever 49 is held down with the coupling rod 54 as a shaft as shown in FIG. 6 to hold down the mating segment 47 of the clincher 38. Consequently, the clincher 38 moves relatively to the clincher holder 37, and the clincher 38 moves down along the clincher slot 39 of the clincher holder 37.

The operating mode of the postprocessing apparatus for staple sheets will be described. In a case where a material 6 to be stapled is inserted between the magazine unit 4 and the clincher unit 5 simultaneously with the actuation of the motor as shown in FIG. 1, the clincher holder 37 moves closer to the magazine unit 4 with the rotation of the crank arm 58 of the clincher unit 5, whereby the material 6 is pressed against the magazine unit 4 by the paper receiving segment 37*a*. As the driver plate 11 and the forming plate 10 remain fixed though the magazine holder 13 of the magazine unit 4 and the magazine 12 pivot on the support shaft 25, a staple in the front end portion of the staple sheet 8 in the magazine is formed in shape and driven out. The leg portion of the staple 8*a* thus driven out is caused to pass through the material 6 on the clincher holder 37 as shown in FIG. 7(*a*) and then guided to move along the lower edge face of the clincher 38 of the clincher slot 39 of the clincher holder 37. In this case, a tilted guide surface 39*a* is provided on the inside of the clincher slot 39 so that the leg portion of the staple 8*a* may become narrower inwardly. As shown in FIG. 6, further, the clincher lever 49 is held down on the shaft 40 of the coupling rod 54 when the roller 59 of the crank arm 58 of the clincher unit 5 mates with the chevron portion 61 with the effect of holding down the mating segment 47 of the clincher 38. As the clincher 38 moves down along the clincher slot 39 of the clincher holder 37 as shown in FIG. 7(*a*), the leg portion of the bent staple 8*a* is strongly pressed against the face of the material 6, whereby the clinching operation is terminated. When the crank arm 58 rotates, the clincher holder 37 moves upward and returns to the initial position. The magazine 12 and the magazine holder 13 also return to the initial position by the force of the return spring 17, so that the next stapling operation is prepared.

Although the magazine 12 and the magazine holder 13 pivot on the support shaft 25, as their front portions are tilted with respect to the base plate 14 beforehand, the driver plate 11 and the forming plate 10 at the pivoting end become parallel to the direction in which the clincher holder 37 moves, whereby the staple is desirably bent.

As the feed link 22 reciprocates round the shaft portion 24 of the bent portion during the stapling operation, the staple sheet 8 is fed out by the feed pawl 23.

With a thick material 6, the outgoing quantity of the clincher holder 37 is restricted. However, since the rotation of the crank arm 58 remains unchanged, the paper thickness is adjusted by moving the shaft 51 along the slit 62 against the spring 63.

In a case where the pressing force applied by the clincher lever 49 against the clincher 38 is released after the staple is bent, the thrust-out pin 46 mating with the back surface of the paper receiving segment 37*a* of the clincher holder 37 pushes back the clincher 38 and the clincher lever 49 with the aid of the compression spring 45 and then the clincher holder 37 moves upward to the initial position.

As set forth above, since the vertically separate type sheet postprocessing apparatus 1 is capable of performing the stapling operation with only one driving source, the wiring is simplified and as it is unnecessary to move both of the forming/driving and clincher portions, the structure is also simplified. Therefore, not only an increase in costs but also trouble can hardly be brought about.

While only a certain embodiment of the invention has been specifically described herein, it will be apparent that numerous modifications may be made thereto without departing from the spirit and scope of the invention.

What is claimed is:

1. A sheet postprocessing apparatus comprising:

a magazine unit including a magazine for storing staple sheets and a driver which is vertically movable relative to the magazine, each of the staple sheets being formed by connecting straight staples together in a form of a sheet;

a clincher unit including a clincher holder and a driving mechanism for vertically moving the clincher holder, said clincher unit being disposed vertically opposite to said magazine unit; and a driving source for driving the driving mechanism of said clincher unit, wherein a material to be stapled is inserted between said magazine unit and said clincher unit, and the clincher holder of said clincher unit is moved closer to said magazine unit by using said driving source such that the clincher unit moves said magazine unit from a first position to a second position with the second position being further from an initial position of the clincher unit than the first position in order to make the driver relatively drive a staple of the staple sheet to pass through the material and bend.

2. The sheet postprocessing apparatus according to claim 1, wherein said driving source is disposed in said clincher unit.

3. The sheet postprocessing apparatus according to claim 1, wherein said magazine unit further includes a magazine holder detachably holding the magazine and a base plate for securing the magazine holder.

4. The sheet postprocessing apparatus according to claim 1, wherein the magazine includes a storage for storing the staple sheets with piling up in plural layers, a forming plate, and a sheet guide for forwardly guiding the staple sheets from the storage.

5. The sheet postprocessing apparatus according to claim 4, wherein the forming plate is held integrally by the driver and the driver has a lower end bent at a right angle.

6. The sheet postprocessing apparatus according to claim 1, wherein the clincher holder includes a lower paper receiving segment, side segments, a clincher slot formed in the paper receiving segment, guide holes formed in the respective side segments, and a shaft coupled to end portions of the side segments.

7. The sheet postprocessing apparatus according to claim 1, wherein the drive mechanism includes two cam levers for driving the clincher holder and a clincher lever disposed between two cam levers, the cam levers and the clincher lever being coupled together.

8. The sheet postprocessing apparatus according to claim 7, wherein a shaft of the clincher holder is mated with a mating slot of each of the cam levers.

9. The sheet postprocessing apparatus according to claim 1, wherein the staple in the magazine is formed in shape and driven out by the driver of said magazine unit pressed by the clincher holder via the material to be stapled.

10. The sheet postprocessing apparatus according to claim 1, wherein the driver is moved by pressing the clincher holder against said magazine unit via the material to be stapled.

11. The sheet postprocessing apparatus according to claim 1, wherein the staple sheets stored in the magazine are piled up in plural layers.

* * * * *